US010018396B2

(12) United States Patent
Cur et al.

(10) Patent No.: US 10,018,396 B2
(45) Date of Patent: Jul. 10, 2018

(54) UNIVERSAL AND FLEXIBLE COOLING MODULE SET (CMS) CONFIGURATION AND ARCHITECTURE

(75) Inventors: Nihat Cur, Saint Joseph, MI (US); Alberto R. Gomes, Saint Joseph, MI (US); Luiz Antonio D. Lopes, Peachtree City, GA (US); Guolian Wu, Saint Joseph, MI (US); Luciana Wasnievski Da Silva, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 898 days.

(21) Appl. No.: 13/108,183

(22) Filed: May 16, 2011

(65) Prior Publication Data

US 2012/0291475 A1 Nov. 22, 2012

(51) Int. Cl.
*F25D 19/00* (2006.01)
*F25D 11/02* (2006.01)

(52) U.S. Cl.
CPC ..... *F25D 11/02* (2013.01); *F25D 2400/04* (2013.01); *F25D 2400/16* (2013.01); *F25D 2500/02* (2013.01); *Y10T 29/49359* (2015.01)

(58) Field of Classification Search
CPC .. F25D 11/02; F25D 2400/04; F25D 2500/02; F25D 19/00; F25D 11/00; F25D 2317/067; B23P 15/26
USPC ..... 62/441, 448, 344, 340, 298; 312/214, 312/404, 116; 29/890.035
See application file for complete search history.

(56) References Cited

U.S. PATENT DOCUMENTS

| | | | | |
|---|---|---|---|---|
| 2,252,010 A | | 8/1941 | Krackowizer | |
| 2,387,465 A | | 10/1945 | Peltier | |
| 2,445,988 A | | 7/1948 | Ayres | |
| 2,511,127 A | | 6/1950 | Philipp | |
| 2,713,776 A | * | 7/1955 | Smith | F25D 11/02 312/321.5 |
| 2,735,277 A | | 2/1956 | Clark | |
| 2,815,649 A | | 12/1957 | Angelus et al. | |

(Continued)

FOREIGN PATENT DOCUMENTS

| | | |
|---|---|---|
| JP | 11182979 | 7/1999 |
| WO | 2009033243 A2 | 3/2009 |

(Continued)

OTHER PUBLICATIONS

European Patent Application No. 12167710.8 filed May 11, 2012, Applicant: Whirlpool Corporation; Extended European Search dated Oct. 18, 2013.

*Primary Examiner* — Frantz Jules
*Assistant Examiner* — Martha Tadesse
(74) *Attorney, Agent, or Firm* — Price Heneveld LLP

(57) ABSTRACT

A refrigerator is provided that includes at least one freezer compartment and at least one refrigerator compartment, wherein the freezer compartment and the refrigerator compartment are defined by a plurality of interior surfaces. The refrigerator further includes a cooling module set (CMS) removably attached to at least one of the plurality of interior surfaces, wherein the CMS is configured to operate in any orientation of a plurality of orientations, and the CMS is further configured to be repositionable with respect to the plurality of interior surfaces to alter a shape of at least one of the refrigerator compartment and the freezer compartment.

25 Claims, 8 Drawing Sheets

(56) References Cited

U.S. PATENT DOCUMENTS 2,827,118 A 3/1958 Wendt
2,840,434 A * 6/1958 Moore ..... F25D 23/04 312/300
3,122,005 A 2/1964 Costantini et al.
3,650,122 A * 3/1972 Lieberman ..... A47B 77/08 62/275
3,708,997 A 1/1973 McLaughlin
3,712,078 A * 1/1973 Maynard ..... F25D 19/00 165/76
3,726,578 A 4/1973 Armstrong
4,019,339 A 4/1977 Anderson
4,041,727 A * 8/1977 Maudlin ..... F24F 13/22 165/181
4,088,466 A 5/1978 Humphrey et al.
4,151,726 A 5/1979 Schlueter
4,410,033 A 10/1983 Wawro et al.
4,638,644 A 1/1987 Gidseg
4,893,478 A 1/1990 Kruck et al.
4,907,419 A 3/1990 Kruck et al.
4,917,256 A 4/1990 Kruck et al.
4,962,649 A 10/1990 Battocletti
5,009,081 A 4/1991 Kruck et al.
5,186,022 A 2/1993 Kim
5,231,847 A 8/1993 Chen et al.
5,375,428 A 12/1994 Leclear et al.
5,577,822 A 11/1996 Seon
5,809,789 A 9/1998 Baker et al.
6,192,704 B1 2/2001 Hiro et al.
6,519,970 B1 2/2003 Rafalovich et al.
6,637,231 B1 * 10/2003 Monfarad ..... F04B 3/00 165/80.2
7,032,408 B2 4/2006 Dentella et al.
7,237,402 B2 7/2007 Hallin et al.
7,360,575 B2 4/2008 Weiss
7,377,124 B2 5/2008 Kim et al.
7,908,873 B1 * 3/2011 Cur ..... F25D 23/061 62/115
2004/0134221 A1 * 7/2004 Fee ..... F25D 19/02 62/448
2005/0150250 A1 7/2005 Allison et al.
2006/0086126 A1 4/2006 Montuoro
2007/0228907 A1 * 10/2007 Luisi ..... F25D 23/069 312/404
2008/0011013 A1 1/2008 Junge
2008/0229773 A1 * 9/2008 Lee ..... F25D 17/04 62/265
2009/0107162 A1 4/2009 Su et al.
2009/0165488 A1 * 7/2009 Chen ..... F25D 17/062 62/298
2010/0058791 A1 * 3/2010 Quesada Saborio B60H 1/3232 62/259.1
2012/0085123 A1 * 4/2012 Wasnievski da Silva ..... F25D 19/02 62/426
2012/0291476 A1 11/2012 Cur et al.
2012/0291477 A1 11/2012 Cur et al.

FOREIGN PATENT DOCUMENTS

WO WO2010043009 * 1/2010
WO 2010043009 A2 4/2010
WO WO2010043009 * 4/2010

* cited by examiner

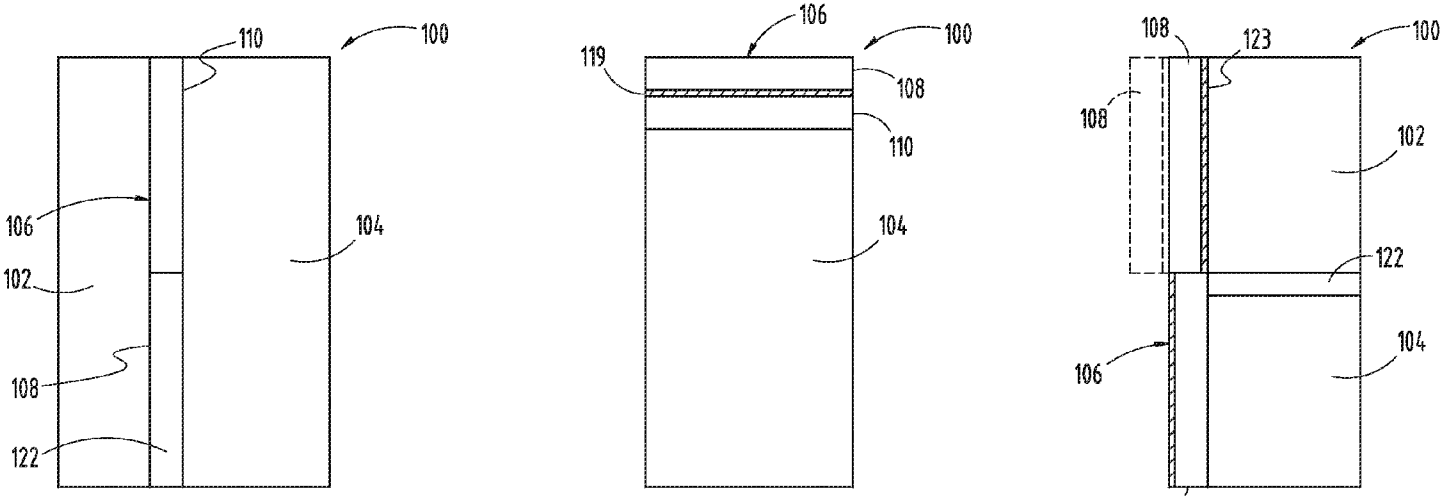
FIG. 1A
FIG. 1B
FIG. 1C
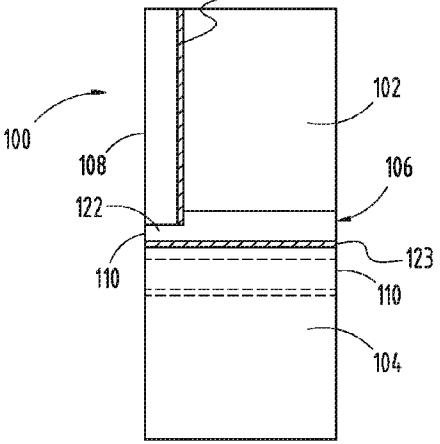
FIG. 1D
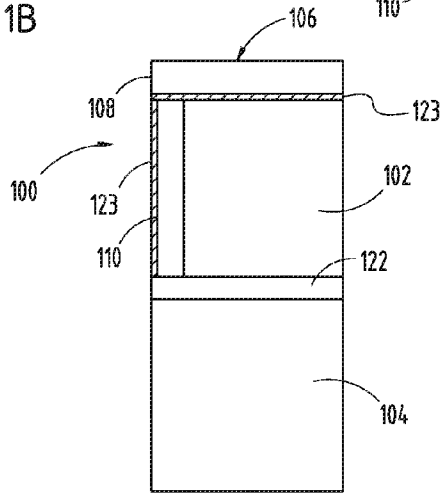
FIG. 1E

UNIVERSAL AND FLEXIBLE COOLING MODULE SET (CMS) CONFIGURATION AND ARCHITECTURE

FIELD OF THE INVENTION

The present invention generally relates to a cooling module set, and more particularly, a refrigerator having a cooling module set configured to operate in any of a plurality of orientations.

BACKGROUND OF THE INVENTION

Generally, refrigerators have their cooling system configured in a way that a modular product is not a practical possibility without substantial redesign and investment, nor is it easy to manufacture various product configurations without substantial investments. Typically, the product introductions and product performances are impacted by complexities imposed by the cooling system within the cabinet construction. Cooling system components in modules are generally widely dispersed and intermingled within the cabinet configuration with a loosely formed high side and low side modules, wherein each product configuration can have unique high side and low side module configurations that require entirely different designs.

SUMMARY OF THE INVENTION

According to one aspect of the present invention, a refrigerator is provided that includes at least one freezer compartment and at least one refrigerator compartment. The freezer compartment and the refrigerator compartment are defined by a plurality of interior surfaces. The refrigerator further includes a cooling module set (CMS) removably attached to at least one of the plurality of interior surfaces. The CMS is configured to operate in any orientation of a plurality of orientations and the CMS is further configured to be repositionable with respect to the plurality of interior surfaces to alter a shape and/or size of at least one of the refrigerator compartment and the freezer compartment.

According to another aspect of the present invention, a refrigerator is provided that includes at least one freezer compartment, at least one refrigerator compartment. The freezer compartment and the refrigerator compartment are defined by a plurality of interior surfaces. At least one door is operably connected to at least one of the freezer compartment and the refrigerator compartment and moveable between a closed position and an open position. The refrigerator further includes a CMS removably attached to at least one of the plurality of interior surfaces. The CMS is configured to operate in any orientation of a plurality of orientations and further configured to be repositionable with respect to the plurality of interior surfaces to alter a shape of at least one of the refrigerator compartment and the freezer compartment, and the at least one door adapted to correspond to the shape of an access opening of at least one of the refrigerator compartment and the freezer compartment.

According to yet another aspect of the present invention, a refrigerator is provided that includes at least one freezer compartment, at least one refrigerator compartment, wherein the freezer compartment and the refrigerator compartment are defined by a plurality of interior surfaces, a first door corresponding to the freezer compartment, and a second door corresponding to the refrigerator compartment. The door(s) may be reconfigurable. The refrigerator further includes a CMS removably attached to at least one of the plurality of interior surfaces. The CMS includes a reconfigurable compressor adapted to have an orientation within the CMS to be reconfigured based upon an orientation of said CMS. The CMS is configured to operate in any orientation of a plurality of orientations and further configured to be repositionable with respect to the plurality of interior surfaces to alter a shape of at least one of the refrigerator compartment and the freezer compartment.

The method of producing an appliance that is reconfigurable by an end user after initial manufacturing at a factory comprising the steps of: providing an insulated appliance cabinet having a plurality of interior surfaces; removably engaging a cooling module set containing mullion in a first position by removably engaging the cooling module set to at least one of the plurality of interior surfaces to thereby form at least one of a freezer compartment and a refrigerator compartment and wherein the cooling module set operates in any orientation of a plurality of orientations; and repositioning the cooling module set containing mullion to a position where the cooling module set is engaged to at least one of the plurality of interior surfaces at a different position than the first position.

These and other aspects, objects, and features of the present invention will be understood and appreciated by those skilled in the art upon studying the following specification, claims, and appended drawings.

BRIEF DESCRIPTION OF DRAWINGS

FIG. 1A is a schematic diagram of a first configuration of a cooling module set within a refrigerator, in accordance with one embodiment of the present invention;

FIG. 1B is a schematic diagram of a second configuration of a cooling module set within a refrigerator, in accordance with one embodiment of the present invention;

FIG. 1C is a schematic diagram of a third configuration of a cooling module set within a refrigerator, in accordance with one embodiment of the present invention;

FIG. 1D is a schematic diagram of a fourth configuration of a cooling module set within a refrigerator, in accordance with one embodiment of the present invention;

FIG. 1E is a schematic diagram of a fifth configuration of a cooling module set within a refrigerator, in accordance with one embodiment of the present invention;

DETAILED DESCRIPTION

For purposes of description herein, the terms "upper," "lower," "right," "left," "rear," "front," "vertical," "horizontal," and derivatives thereof shall relate a cooling module set (CMS). However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 6A:
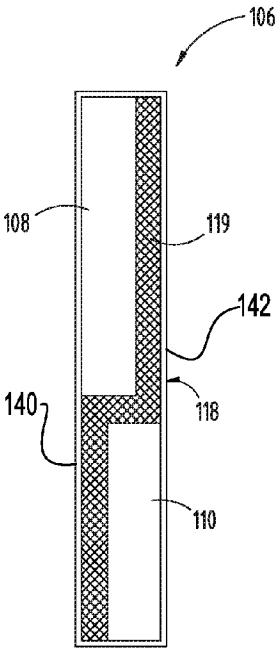
FIG. 6*a* is a schematic diagram of a vertically oriented cooling module set, in accordance with one embodiment of the present invention.
Figure 6B:
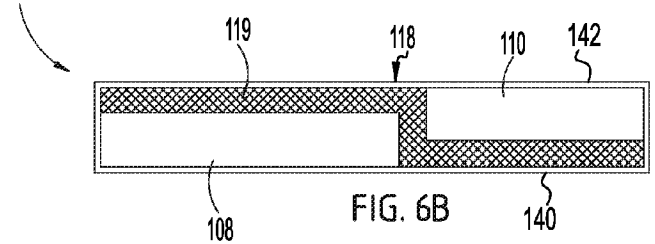
FIG. 6*b* is a schematic diagram of a horizontally oriented cooling module set, in accordance with one embodiment of the present invention.

With respect to FIGS. 1A-12, a refrigerator is generally shown in FIGS. 1A-1I at reference identifier 100. The refrigerator 100 can include at least one freezer compartment 102 and at least one refrigerator compartment 104. The refrigerator 100 can further include a CMS generally indicated at reference identifier 106. The CMS 106 can be adapted to define at least a portion of an envelope of the freezer compartment 102, the refrigerator compartment 104, or a combination thereof. The CMS 106 can have a high pressure side 108 and a low pressure side 110. The high pressure side 108 of the CMS 106 can include an orientation-flexible compressor 112, a condenser 113 fluidly connected with the orientation-flexible compressor 112 (FIG. 3), or a combination thereof. The low pressure side 110 of the CMS 106 can include an evaporator, generally indicated at reference identifier 115 (FIG. 3). Typically, the evaporator 115 includes at least one evaporator fan 116 proximate an evaporator coil 114. As shown in FIGS. 6*a* and 6*b*, the CMS 106 can further include at least one housing 118 adapted to enclose the orientation-flexible compressor 112, the condenser 113, the evaporator 115, or a combination thereof, and an insulating panel 119 forming at least a portion of the housing 118, and substantially separating the high pressure side 108 and the low pressure side 110. The CMS 106 can be configured to operate in any of a plurality of orientations, as described in greater detail herein and shown in generally vertical (FIG. 6*a*) and horizontal (FIG. 6*b*) orientations. A portion of the CMS can optionally define all or part of an exterior wall 140 and interior wall 142. Typically, the various operating positions of the CMS 106 are based upon the orientation-flexible compressor 112.

Figure 12:
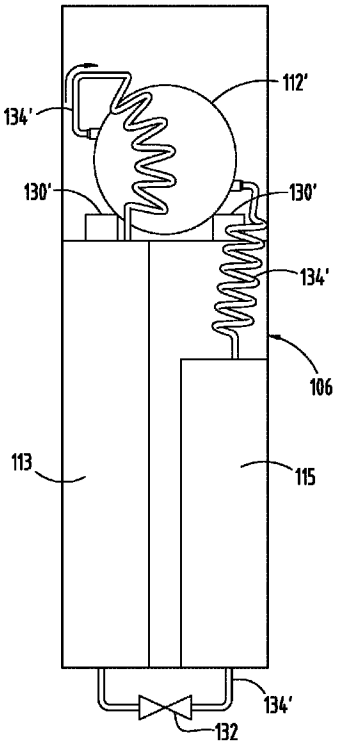
FIG. 12 is a schematic diagram of a cooling module set in a vertical orientation, the cooling module set having a repositionable compressor, in accordance with one embodiment of the present invention.
Figure 10:
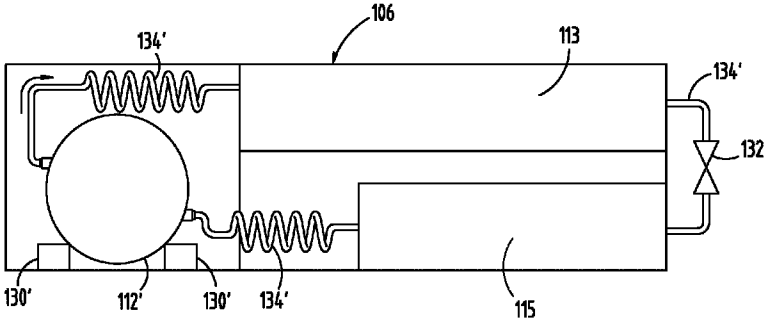
FIG. 10 is a schematic diagram of a cooling module set in a horizontal orientation, the cooling module set having a repositionable compressor, in accordance with one embodiment of the present invention.
Figure 11:
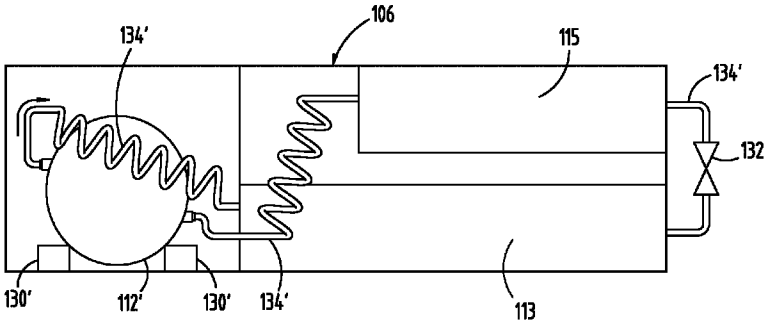
FIG. 11 is a schematic diagram of a cooling module set in a horizontal orientation, the cooling module set having a repositionable compressor, in accordance with one embodiment of the present invention.

For purposes of explanation and not limitation, in operation, the orientation-flexible compressor 112 can be configured to operate in various positions, and thus, the CMS 106 can be placed within the refrigerator 100 in various positions based upon the orientation of the orientation-flexible compressor 112 within the CMS 106. Therefore, the CMS 106 can be a standard configuration for various refrigerator models, and then placed within different portions of the refrigerator 100 based upon the particular refrigerator 100 design without (mechanical) modification to the orientation-flexible compressor. According to an alternate embodiment, the compressor 112' can be a repositionable compressor, as illustrated in FIGS. 10-12, and discussed in greater detail herein. The high pressure side 108 and the low pressure side 110 can be operably connected allowing for increase orientations of the CMS 106 with respect to the refrigerator.

Figure 5:
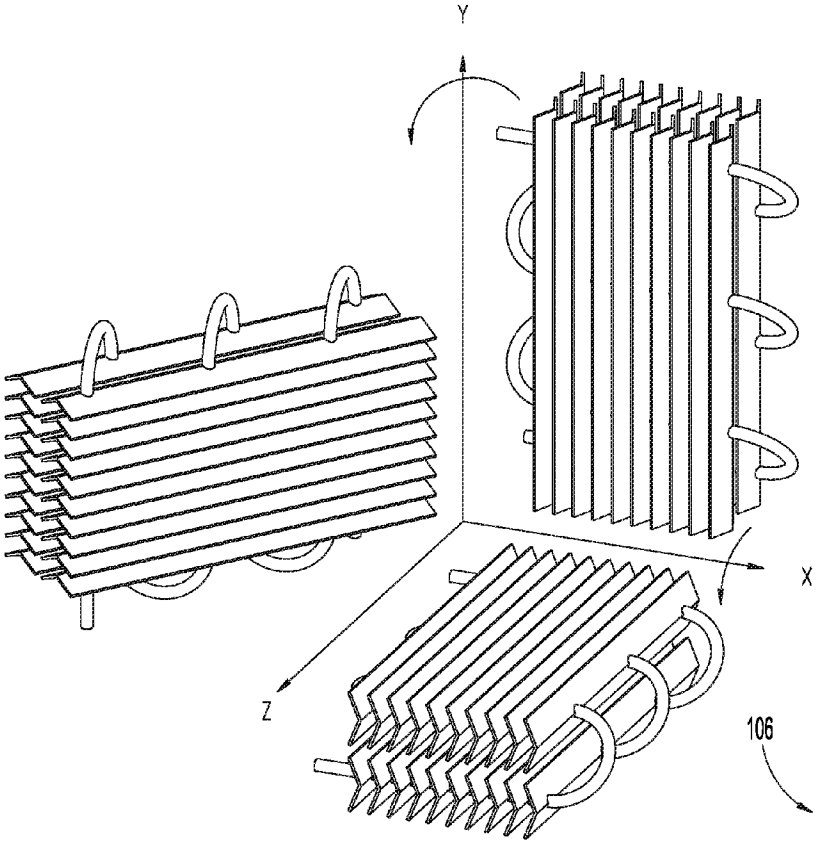
FIG. 5 is a chart illustrating x, y, z axis with respect to exemplary operating orientations of a cooling module set, in accordance with one embodiment of the present invention.

According to one embodiment, as illustrated in FIG. 5, the CMS 106 can be configured to operate when positioned in approximately a vertical position in parallel with a normal operating orientation of the refrigerator 100, approximately horizontally with respect to the normal operating orientation of the refrigerator 100, rotated approximately ninety degrees (90°) (e.g., +/−90° from an axis of origin), rotated approximately one hundred eighty degrees (180°) (e.g., +/−180° from an axis of origin), rotated approximately two hundred seventy degrees (270°) (e.g., +/−270° from an axis of origin), the like, or a combination thereof. However, it should be appreciated by those skilled in the art that the CMS 106 can be configured to operate when in other suitable orientations. Typically, the plurality of operating orientations of the CMS 106 based upon the operating orientations of the orientation-flexible compressor 112, the position of the repositionable compressor 112', the evaporator 115, or a combination thereof. According to one embodiment, the orientation-flexible compressor 112 can be an oil-less compressor. An exemplary CMS and non-orientation-flexible compressor are described in International Publication No. WO 2010/043009, entitled "REFRIGERATING MODULE FOR REFRIGERATOR APPARATUS OF FORCED VENTILATION AND REFRIGERATOR APPARATUS," the entire disclosure hereby being incorporated herein by reference.

According to one embodiment, the refrigerator 100 can further include a mullion 122 (FIGS. 1A, 1C-1E, and 1G-1I) configured to define at least a portion of the envelope of the freezer compartment 102 and the refrigerator compartment 104. The mullion 122 can also be configured to be positioned and extend approximately vertical with respect to a normal operating position of the refrigerator 100, approximately horizontal with respect to a normal operating position of the refrigerator 100, or a combination thereof. The refrigerator 100 having at least one freezer compartment 102 and at least one refrigerator compartment 104 can include a refrigerator 100 having one freezer compartment 102 and one refrigerator compartment 104, as illustrated herein for purposes of explanation and not limitation, a refrigerator 100 having two or more freezer compartments 102, and/or a refrigerator 100 having two or more refrigerator compartments 104.

With respect to FIGS. 1A-1I, 6*a* and 6*b*, at least a portion of the housing 118 can include an insulated wall section 123, according to one embodiment. Typically, the insulated wall section 123 can define a substantial portion of a wall section 123 of the freezer compartment 102, the refrigerator compartment 104, or a combination thereof. In such an embodiment, by integrating an insulated wall section 123 with the CMS 106, a compactness of the CMS can be increased, such as, but not limited to, reducing a wall thickness at least partially separating the high pressure side 108 and the low pressure side 110.

Typically, the insulated panel 119 defines a substantial portion of the wall section, including the insulated wall section 123 of the freezer compartment 102, the refrigerator compartment 104, or a combination thereof. Additionally or alternatively, the insulated panel 119 can define a substantial portion of a door section of the freezer compartment 102, the refrigerator compartment 104, or a combination thereof. The insulated panel 119 can be configured to insulate against heat gain for external conditions with respect to the low pressure side 110. In other words, the insulated panel 119 can be configured to insulate a portion of the CMS 106 from another portion of the CMS 106, ambient conditions or surroundings, other components of the refrigerator 100, the like, or a combination thereof. By way of explanation and not limitation, the insulated wall section 123 can be a vacuum panel insulated wall section.

According to one embodiment, the CMS 106 can be adapted to be reconfigurable with respect to the freezer compartment 102, the refrigerator compartment 104, or a combination thereof, such that a shape of the freezer compartment 102, the refrigerator compartment 104, or a combination thereof is altered. In such an embodiment (see FIGS. 13-14), the CMS 106 can be adapted to be reconfigurable to alter a ratio of the freezer compartment 102 and the refrigerator compartment 104. In an embodiment, wherein the refrigerator 100 is a multi-door refrigerator 100, the refrigerator 100 can include first and second reconfigurable doors. Typically, a size of the first door can be reconfigurable to correspond to the freezer compartment 102, and the size of the second door can be reconfigurable to correspond to the refrigerator compartment 104. Additionally, the mullion 122 can be configured to be repositionable. The repositioning of the mullion 122 can correspond to the reconfiguring of the first and second reconfigurable doors.

Figure 2:
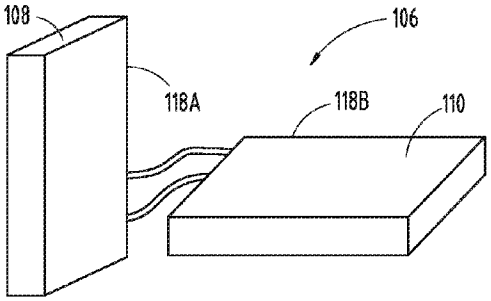
FIG. 2 is a perspective view of a cooling module set having a high side module operably connected to low side module, in accordance with one embodiment of the present invention.
Figure 3:
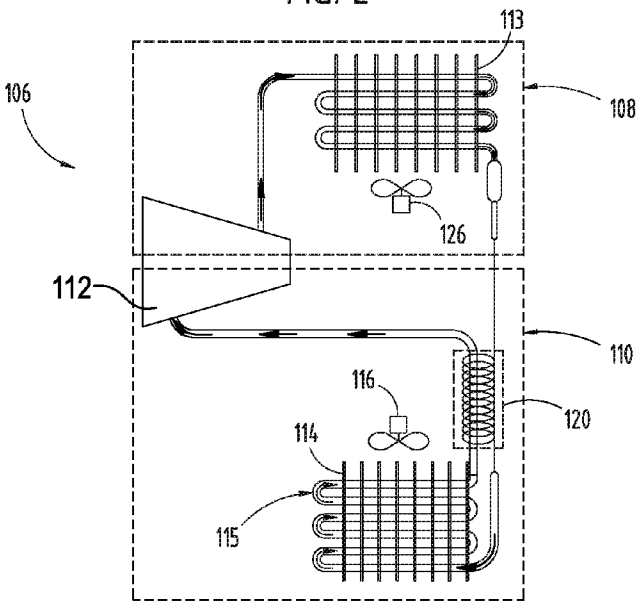
FIG. 3 is a schematic diagram of a refrigerator system, in accordance with one embodiment of the present invention.

As exemplary illustrated in FIGS. 2 and 3, the housing 118 (FIG. 2) can include a first housing 118A and a second housing 118B that are operably connected. In such an embodiment, the first housing 118A can be a high pressure side 108 and encloses the orientation-flexible compressor 112, which typically operates in any orientation without modification, a condenser 113, a condenser fan 126, other components, or a combination thereof. The second housing 118B can be a low pressure side 110, and enclose an evaporator coil 115, the evaporator fan 116, a defroster device, an expansion device 120, other components, or a combination thereof.

According to an embodiment wherein the CMS 106 can be at least partially or entirely enclosed in the mullion 122, one or more of the components of the CMS 106 can be placed within spaces created in the mullion 122 that can separate the freezer compartment 102 and the refrigerator compartment 104, other suitable compartments in the refrigerator 100, or a combination thereof. Typically, such module placement or docking of the CMS 106 within the mullion 122 can be based upon the flexibility in orientation of the orientation-flexible compressor 112 or the repositionable compressor 112'.

Additionally, the CMS 106 can include multiple docking ports that are configured to operably connect with the compressor 112, 112'. The CMS 106 can be used in various refrigerator 100 designs, without requiring different housing 118 designs. Thus, the compressor 112, 112' can operably connect to one of the docking ports of the CMS 106, such that the CMS 106 can be used in various environments.

An alternate embodiment, wherein the CMS 106 can be at least partially enclosed in the mullion 122, can include the CMS 106 having the first and second housings 118A, 118B (FIG. 2). In such an embodiment, the second housing 118B (e.g., low pressure module) can be enclosed within the mullion 122. The second housing 118B can be in close proximity to the first housing 118A (e.g., the high pressure module), which can include the orientation-flexible compressor 112, and the first and second housings 118A, 118B can be operably connected to one another. Typically, the CMS 106 can have a reduced amount of interfaces with a cabinet of the refrigerator 100.

With such an operable connection between the first and second housings 118A, 118B, the CMS 106 can be adapted to be in a planar orientation (FIGS. 1A and 1G), an approximately ninety degree (90°) orientation (FIG. 1D, 1E, 1H, or 1I), a stacked orientation (FIGS. 1B and 1F), an offset orientation (FIGS. 1C and 1D), or the like. Typically, the operable connection between the first and second housings 118A, 118B can be a rotatable connection, typically a hinged connection. However, it should be appreciated by those skilled in the art that other suitable operable connections between the first and second housings 118A, 118B can be utilized.

Figure 9:
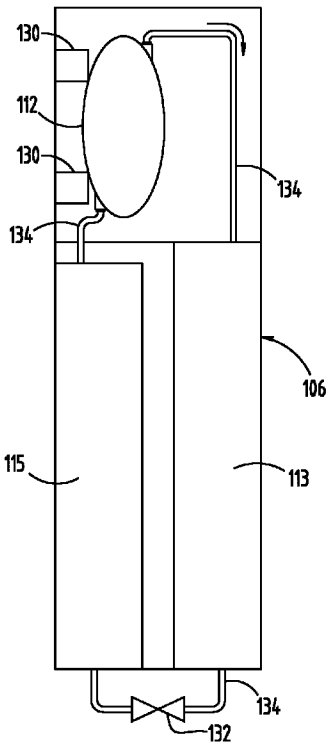
FIG. 9 is a schematic diagram of a cooling module set in a vertical orientation, the cooling module set having an orientation-flexible compressor, in accordance with one embodiment of the present invention.
Figure 7:
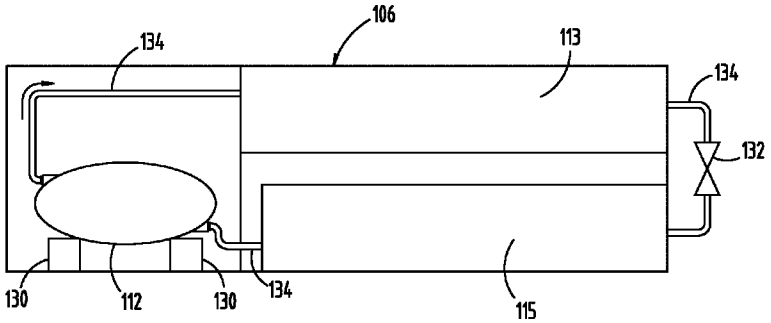
FIG. 7 is a schematic diagram of a cooling module set in a horizontal orientation, the cooling module set having an orientation-flexible compressor, in accordance with one embodiment of the present invention.
Figure 8:
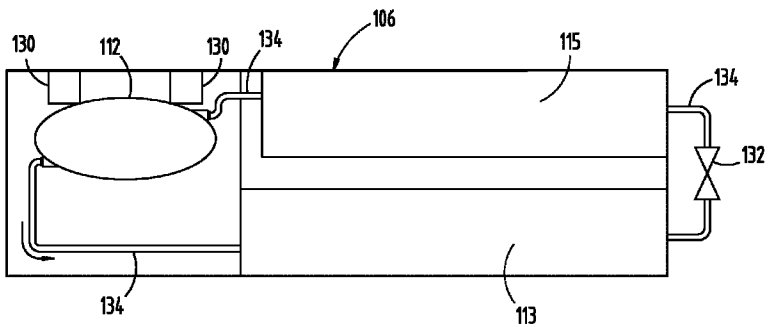
FIG. 8 is a schematic diagram of a cooling module set in a horizontal orientation, the cooling module set having an orientation-flexible compressor, in accordance with one embodiment of the present invention.

With respect to FIGS. 7-9, the CMS 106 is exemplary illustrated in a plurality of positions, wherein the CMS 106 includes the orientation-flexible compressor 112. FIG. 8 illustrates the CMS 106 rotated approximately one hundred eighty degrees (180°) from the position illustrated in FIG. 7. FIG. 9 illustrates the CMS 106 rotated approximately ninety degrees (90°) from the position illustrated in FIG. 7. Typically, the orientation of the orientation-flexible compressor within the CMS 106 does not need to be altered as the orientation of the CMS 106 is changed. The orientation-flexible compressor 112 can be non-releasably connected to the CMS 106 (e.g., to an interior side of the housing 118) by one or more fastening devices 130. Further, connections 134 between the orientation-flexible compressor 112 and the other components of the CMS 106 (e.g., the condenser 113 and the evaporator 115) may not be flexible or changeable based upon the orientation of the CMS 106 being altered. The connection between the condenser 113 and the evaporator 115 can have a throttle or expansion valve 132. It should be appreciated by those skilled in the art that the CMS 106 having the orientation-flexible compressor 112 can be orientated in other orientations not illustrated in FIGS. 7-9.

As to FIGS. 10-12, the CMS 106 is exemplary illustrated in a plurality of positions, wherein the CMS 106 includes the repositionable compressor 112'. The repositionable compressor 112' can be a standard compressor with oil (e.g., non-oil-less compressor) that is adapted to be repositioned within the CMS 106. For purposes of explanation and not limitation, the repositionable compressor 112', during operation, is stable with an approximately horizontal orientation due to a flow of a lubricating material. Typically, the repositionable compressor 112' can include one or more releasable fastening devices 130' that are configured to adequately securely connect the repositionable compressor 112' to the CMS 106 (e.g., to an interior side of the housing 118). The connections 134' between the repositionable compressor 112' and other components of the CMS 106 (e.g., the condenser 113 and the evaporator 115) can be a flexible material, such as, but not limited to, elastomer (e.g., YELLOW JACKET™), thick-walled soft copper tubing, coiled tubing, the like, or a combination thereof.

FIG. 11 illustrates the CMS 106 rotated approximately one hundred eighty degrees (180°) from the position illustrated in FIG. 10. FIG. 12 illustrates the CMS 106 rotated approximately ninety degrees (90°) from the position illustrated in FIG. 10. It should be appreciated by those skilled in the art that the CMS 106 having the repositionable compressor 112' can be orientated in other orientations not illustrated in FIGS. 10-12.

In an embodiment wherein at least a portion of the housing 118 can include the insulated wall section 123, the CMS 106 can have at least the compressor 112, 112' and the condenser 113 on a first side (e.g., the high pressure side 108 and/or the first housing 118A) separated by the insulated wall 123, from at least the evaporator coil 115 on a second side (e.g., the low pressure side 110 and/or the second housing 118B). The freezer compartment 102 and the refrigerator compartment 104 can be reconfigured during the design and manufacturing process, by the post-sale consumer, or a combination thereof while utilizing the same CMS 106 design, such that the CMS 106 can be in any one of a plurality of operating orientations (FIGS. 1A-1I). Thus, the CMS 106 can utilize at least a portion of an external wall of a cabinet of the refrigerator 100 or a portion of such a wall within an aperture or enclosing. The vacuum panel insulated wall 123 can be used to reduce an amount of space occupied by the CMS 106 within the refrigerator 100. For purposes of explanation and not limitation, the CMS 106 can be used with a back wall, a top wall, a bottom wall, a door assembly, or a combination thereof, of the refrigerator 100. The CMS 106 can have a single motor that supplies power to both the evaporator fan 116 and the condenser fan 126.

According to one embodiment (see FIGS. 13-14), the refrigerator 100 can include flexible or re-adjustable compartments (e.g., the freezer compartment 102 and the refrigerator compartment 104), a portable CMS 106 that is operably connected to the refrigerator 100, but housed external to the refrigerator 100, the CMS 106 being configured to be fixedly repositionable (e.g., for top mount or bottom mount, or side by side), and/or the CMS 106 being configured to be repositionable during manufacturing (e.g., at the factory) and/or by the consumer, have repositionable doors, the CMS 106 can have shared or dedicated wiring, or a combination thereof. With such a repositionable CMS 106, different product configurations can be designed at the manufacturing level utilizing the same CMS 106. By way of explanation and not limitation as shown generally in FIGS. 13-15, the CMS 106 can be at least partially enclosed in the mullion 122, and the mullion 122 can be shifted to alter a ratio of the freezer compartment 102 and the refrigerator compartment 104. If the consumer can adjust the ratio of the freezer and refrigerator compartments, the doors may be reconfigurable, such as, but not limited to, a roller accordion door, a collapsible door, the like, or a combination thereof, or readily removed and replaced with a differently sized door designed to match the change in size of the access openings of the freezer compartment and the refrigerator compartment.

The mullion 122 can be configured to enclose one or more cold air conduits from the CMS 106, according to one embodiment. Typically, the CMS 106 can have the first and second housings 118A, 118B, wherein one housing (e.g., the high side 108 or first housing 118A) can be fixed and a second housing (e.g., the low side 110 or second housing 118B) can be operably connected thereto, such as, but not limited to, rotatably connected. The second housing 118B can be at least part of a wall. The connection between the high pressure side 108 and the low pressure side 110 can be a fluid connection. Additionally, the high pressure side 108 can be in electrical communication with the low pressure side 110, either directly or indirectly (e.g., via other intermediate electrical components, such as, but not limited to, a controller).

Figure 1G:
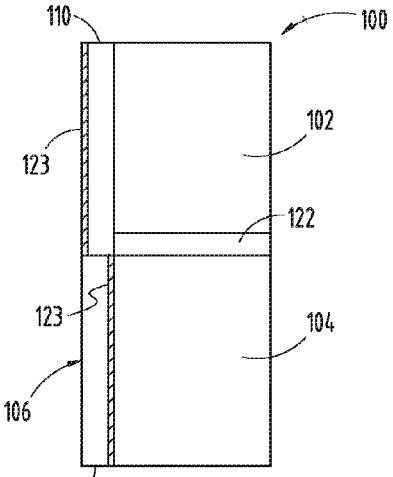
FIG. 1G is a schematic diagram of a seventh configuration of a cooling module set within a refrigerator, in accordance with one embodiment of the present invention.
Figure 1I:
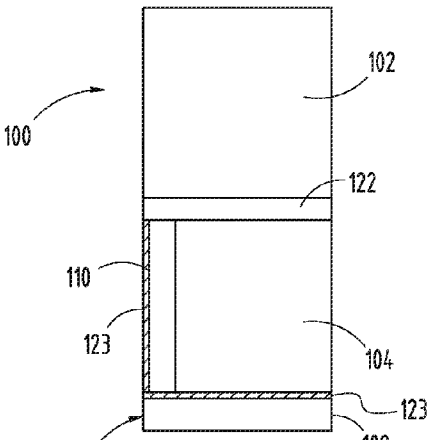
FIG. 1I is a schematic diagram of a ninth configuration of a cooling module set within a refrigerator, in accordance with one embodiment of the present invention.
Figure 1F:
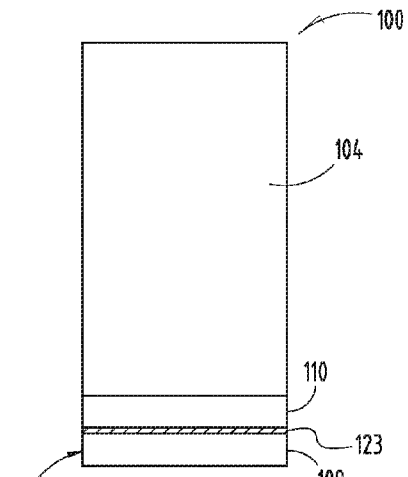
FIG. 1F is a schematic diagram of a sixth configuration of a cooling module set within a refrigerator, in accordance with one embodiment of the present invention.
Figure 1H:
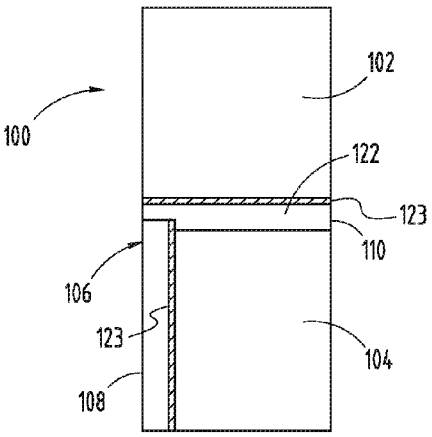
FIG. 1H is a schematic diagram of an eighth configuration of a cooling module set within a refrigerator, in accordance with one embodiment of the present invention.
Figure 4A:
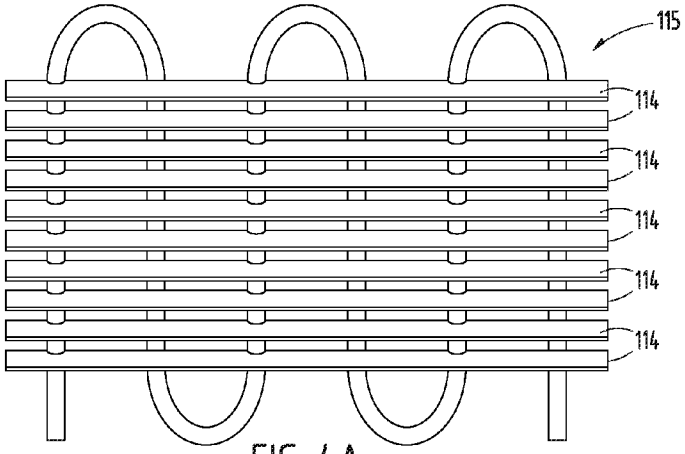
FIG. 4A is a front view of an evaporator including an evaporator coil and fins, in accordance with one embodiment of the present invention.
Figure 4B:
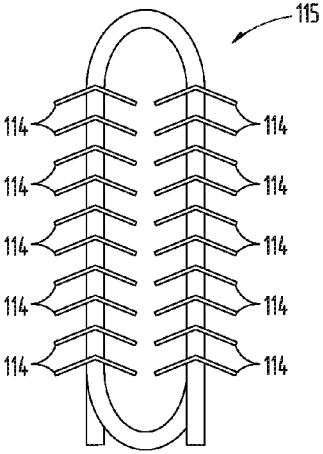
FIG. 4B is a side view of the evaporator of FIG. 4A.

According to one embodiment, as illustrated in FIG. 4, the evaporator coil 115 can include a plurality of fins 114 configured to have a contour allowing defrost water to move across the contour and off of the fins 114 when the CMS 106 is in one of a plurality of orientations. Typically, under operating conditions, frost can accumulate off of the fins 114 and the evaporator coil 115, and the frost can be removed by defrosting and allowing the frost to melt and drop from the fins 114 and coil 115. By configuring the fins 114 in a "V" shape, when the evaporator is in a horizontal position, the "V" can be oriented downward so the moisture falls by gravity.

Advantageously, the refrigerator 100 and the CMS 106 can be configured so that the CMS can be a standard design and function within various types of models of the refrigerator 100. Thus, the CMS 106 can have the same design while being located in different operating orientations within the refrigerator 100. It should be appreciated by those skilled in the art that additional or alternative advantages may be present from the refrigerator 100 and CMS 106. It should further be appreciated by those skilled in the art that the components described herein may be combined in different or alternative manners not explicitly described herein.

Figure 13A:
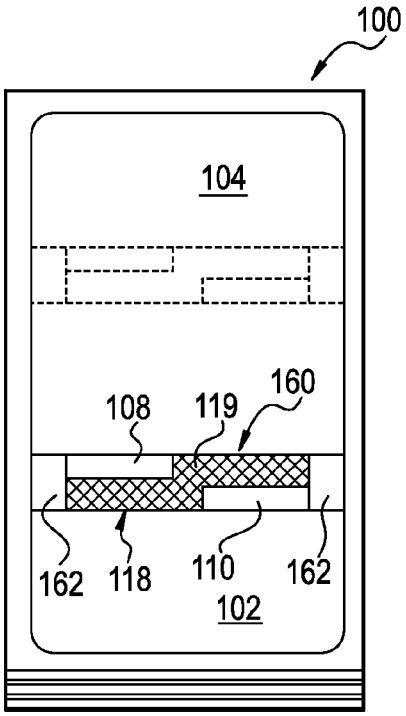
FIGS. 13*a* and 13*b* are schematic diagrams of a horizontally positioned cooling module set within an optionally repositionable horizontal mullion in a freezer bottom mount configuration, in accordance with one embodiment of the present invention with 13*b* showing an access port cut into the appliance cabinet for egress of condensing unit heat.
Figure 13B:
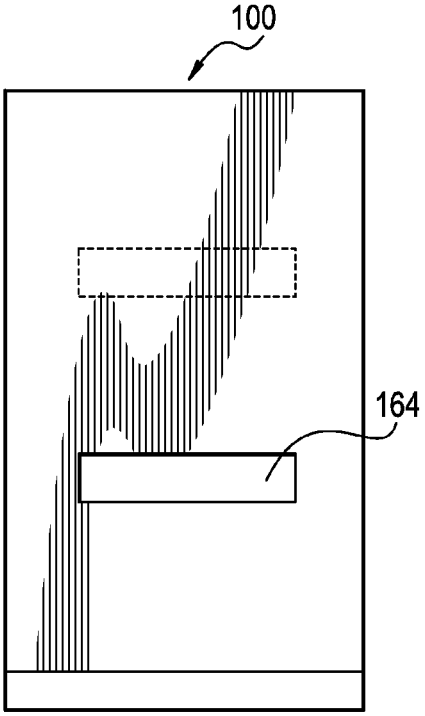

As shown in FIGS. 13*a* and 13*b*, a bottom mount freezer configuration is shown. Freezer compartment 102 is separated by the mullion 160 containing the CMS. The CMS may occupy a position within the mullion anywhere along the length of the mullion including making up the entirety of the mullion, the left side, the right side, or the middle of the mullion with the remainder of the mullion either being non-insulated housing or more typically an insulated housing. The typically insulated housing portions 162 are typically of a length sufficient to bridge between the exterior walls of a standardized cabinet. As shown in FIG. 13*a* with the dashed depiction of the mullion, the mullion section can be repositioned to enlarge the freezer section if so desired. FIG. 13*b* shows the configuration access port 164, which is cut into the generic cabinet for egress of condensing unit heat. As such, the CMS can be assembled to the cabinet from the front or from behind if a large enough access port is provided. A plurality of configuration access ports may be configured in the appliance cabinet and sealed with a removable (typically insulated) plug or covering when one or more of the configuration access ports are not operably engaged with the cooling module set.

Figure 14A:
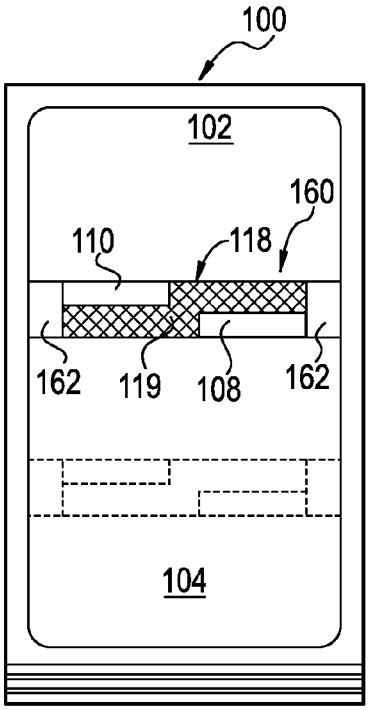
FIGS. 14*a* and 14*b* are schematic diagrams of an optionally repositionable horizontally positioned cooling module set within an optionally repositionable vertical mullion in a freezer top mount configuration in accordance with one embodiment of the present invention.
Figure 14B:
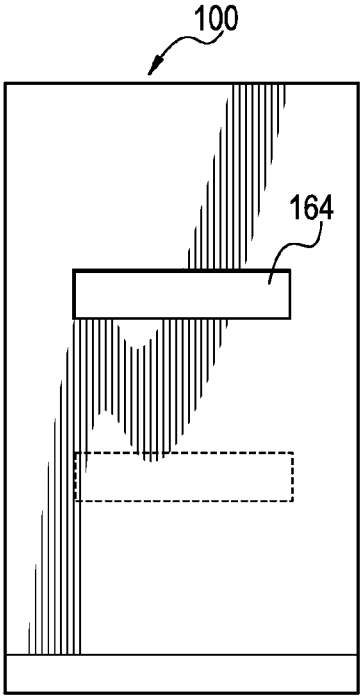
Figure 15A:
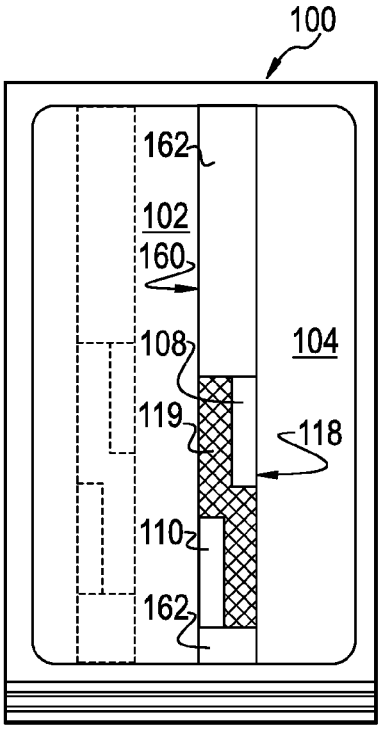
FIGS. 15*a* and 15*b* are schematic drawings of an optionally repositionable vertically positioned cooling module set within an optionally repositionable vertical mullion in a freezer top mount configuration in accordance with one embodiment of the present invention, with 15*b* showing an access port cut into the appliance cabinet for egress of condensing unit heat.
Figure 15B:
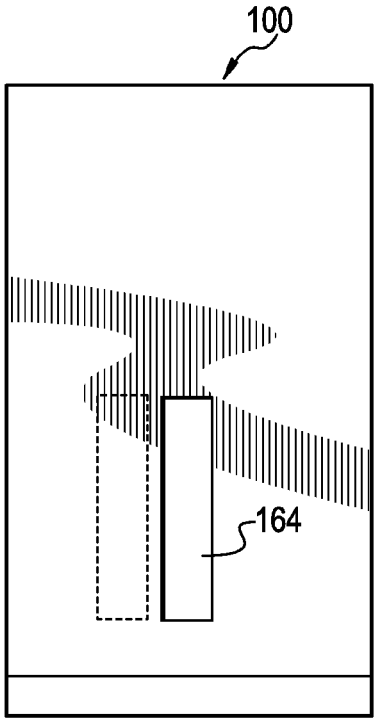
Figure 16A:
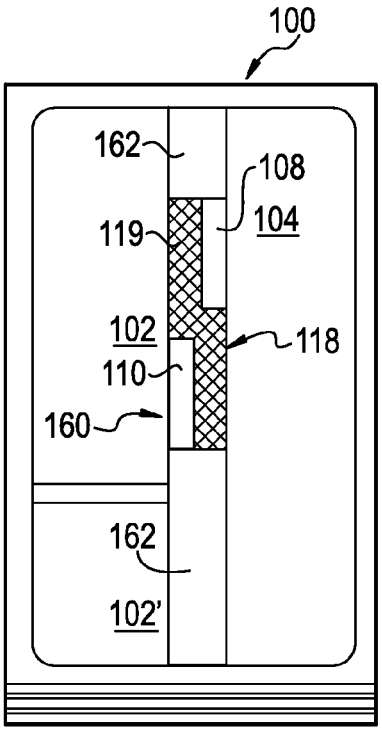
FIGS. 16*a* and 16*b* are schematic drawings of an optionally repositionable vertically positioned cooling module set within an optionally repositionable vertical mullion in a freezer top mount configuration in accordance with one embodiment of the present invention, with 16*b* showing an access port cut into the appliance cabinet for egress of condensing unit heat and incorporating a divided freezer compartment.
Figure 16B:
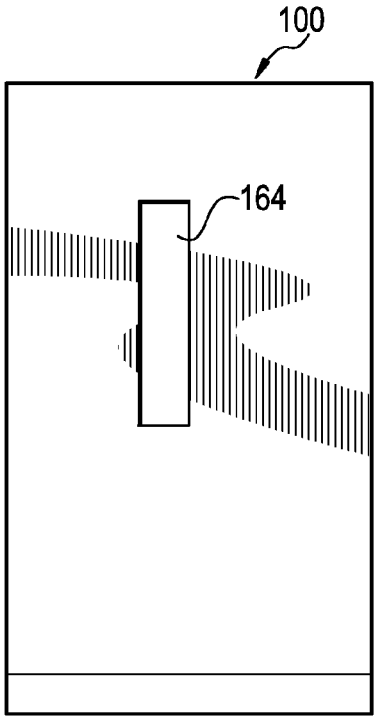

A similar depiction is shown in FIGS. 14*a* and 14*b*, which depict a top mount freezer-type refrigerator appliance. FIGS. 15*a* and 15*b* similarly show a side by side freezer configuration. The typically insulated, but optionally non-insulated portions 162 of the vertically oriented mullion section are typically longer due to the length necessary to traverse between the top wall and the bottom wall of the refrigerator 100. Finally, FIGS. 16*a* and 16*b* show a configuration with a divided freezer portion 102 and 102'. The configuration access ports 164 can be cut into the generic cabinet at various locations and the appliance potentially reconfigured during production of the appliance at the factory after the production of the appliance at the factory, which would allow for consumer adjustment of the ratio of the volume of the freezer compartment to the volume of the refrigerator compartment within the appliance.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A refrigerator comprising:

at least one freezer compartment;

at least one refrigerator compartment, wherein the freezer compartment and the refrigerator compartment are defined by a plurality of interior surfaces;

a cooling module set containing mullion configured to be repositionable with respect to the plurality of interior surfaces including at least one vertical surface and removably attached to at least one of the plurality of interior surfaces, wherein the cooling module set containing mullion is configured to operate in any orientation of a plurality of orientations, and the cooling module set containing mullion is further configured to be repositionable with respect to the plurality of interior surfaces to alter an interior volume of at least one of the refrigerator compartment and the freezer compartment; and wherein the cooling module set comprises an orientation-flexible compressor configured to operate in any orientation including at least a vertical orientation without affecting the operation of the orientation flexible compressor and without modification as the orientation of the cooling module set is changed and the cooling module set supplies cooling to the at least one freezer compartment temperature at a freezer compartment temperature and to the at least one refrigerator compartment at a refrigerator compartment temperature that is higher than the freezer compartment temperature.

2. The refrigerator of claim 1, wherein the cooling module set is configured to operate in a plurality of positions without affecting the operation of the cooling module set and wherein the plurality of positions include and are chosen from the group consisting of: an approximately vertical position with respect to a normal operating orientation of the refrigerator and an approximately horizontal position with respect to the normal operating orientation of the refrigerator.

3. The refrigerator of claim 1, wherein the cooling module set containing mullion is further configured to be repositionable, such that a ratio of the refrigerator compartment and the freezer compartment are altered when the cooling module set is repositioned.

4. The refrigerator of claim 3 further comprising at least one reconfigurable door operably connected to at least one of the freezer compartment and the refrigerator compartment and wherein the cooling module set further comprises a high pressure side which includes the orientation-flexible compressor configured to operate in at least both of a horizontal and the vertical orientation, and a condenser and a low pressure side which includes an evaporator comprising fins and at least one housing adapted to enclose the orientation-flexible compressor, the condenser, and the evaporator, wherein the at least one reconfigurable door is reconfigurable for top mount, bottom mount or side by side doors.

5. The refrigerator of claim 4 further comprising a first door corresponding to the freezer compartment, wherein a size of the first door at least approximately corresponds with an access opening of the freezer compartment; and a second door corresponding to the refrigerator compartment, wherein a size of the second door at least approximately corresponds with an access opening of the refrigerator compartment and wherein the cooling module set further comprises an insulating panel forming at least a portion of the housing and separating the high pressure side and the low pressure side and wherein the fins of the evaporator are configured in a V-shape cross-section when the evaporator is in a horizontal position.

6. The refrigerator of claim 1, wherein the cooling module set comprises at least two envelopes that are one of fixedly connected and flexibly connected.

7. The refrigerator of claim 1, wherein the cooling module set is attached to at least one of the plurality of interior surfaces, such that the cooling module set is one of a top mount configuration and a bottom mount configuration of the at least one freezer compartment.

8. The refrigerator of claim 1 further comprising a mullion, wherein the cooling module set is at least partially enclosed in the mullion.

9. A refrigerator comprising:

at least one freezer compartment;

at least one refrigerator compartment, wherein the freezer compartment and the refrigerator compartment are defined by a plurality of interior surfaces;

at least one door operably connected to at least one of the freezer compartment and the refrigerator compartment; and a cooling module set removably attached to at least one of the plurality of interior surfaces, wherein the cooling module set is configured to operate in any orientation of a plurality of orientations, the cooling module set being further configured to be repositionable with respect to the plurality of interior surfaces to alter a shape of at least one of the refrigerator compartment and the freezer compartment, and the at least one door adapted to correspond to the shape of an access opening of at least one of the refrigerator compartment and the freezer compartment; and wherein the cooling module set comprises an orientation-flexible compressor configured to operate in at least both a vertical and a horizontal orientation without modification as the orientation of the cooling module set is changed.

10. The refrigerator of claim 9, wherein the cooling module set is configured to operate in a plurality of positions without affecting the operation of the cooling module set and wherein the plurality of positions include and are chosen from the group consisting of: an approximately vertical position with respect to a normal operating orientation of the refrigerator and an approximately horizontal position with respect to the normal operating orientation of the refrigerator.

11. The refrigerator of claim 9, wherein the cooling module set is further configured to be repositionable, such that a ratio of the refrigerator compartment and the freezer compartment are altered.

12. The refrigerator of claim 9, wherein the at least one door comprises: a first reconfigurable door corresponding to the freezer compartment, such that a size of the first door at least approximately corresponds with an access opening of the freezer compartment; and a second door corresponding to the refrigerator compartment, such that a size of the second door at least approximately corresponds with an access opening of the refrigerator compartment.

13. The refrigerator of claim 9, wherein the cooling module set comprises at least two envelopes that are one of fixedly connected and flexibly connected.

14. The refrigerator of claim 9, wherein the cooling module set is attached to at least one of the plurality of interior surfaces, such that the cooling module set is one of a top mount and a bottom mount.

15. The refrigerator of claim 9 further comprising a mullion, wherein the cooling module set is at least partially enclosed in the mullion.

16. A refrigerator that is reconfigurable by an end user after initial manufacturing at a factory, the refrigerator comprising:

at least one freezer compartment;

at least one refrigerator compartment, wherein the freezer compartment and the refrigerator compartment are defined by a plurality of interior surfaces;

a first door corresponding to the freezer compartment;

a second door corresponding to the refrigerator compartment; and a cooling module set removably attached to at least one of the plurality of interior surfaces and supplying cooling to the at least one freezer compartment and the at least one refrigerator compartment, the cooling module set comprising:

a reconfigurable compressor adapted to have an orientation within the cooling module set to be reconfigured based upon an orientation of the cooling module set, wherein the cooling module set and the reconfigurable compressor are configured to operate in at least both a horizontal and a vertical orientation and the cooling module set being further configured to include a mullion and be repositionable with respect to the plurality of interior surfaces to alter a shape of at least one of the refrigerator compartment and the freezer compartment and still function.

17. The refrigerator of claim 16, wherein the cooling module set is further configured to be repositionable, such that a ratio of the refrigerator compartment and the freezer compartment are altered and wherein the cooling module set is configured to operate in a plurality of positions without affecting the operation of the cooling module set and wherein the plurality of positions include and are chosen from the group consisting of: an approximately vertical position with respect to a normal operating orientation of the refrigerator and an approximately horizontal position with respect to the normal operating orientation of the refrigerator.

18. The refrigerator of claim 17, wherein the cooling module set comprises at least two envelopes that are one of fixedly connected and flexibly connected.

19. The refrigerator of claim 18, wherein the cooling module set is attached to at least one of the plurality of interior surfaces, such that the cooling module set is one of a top mount and a bottom mount.

20. The refrigerator of claim 18 further comprising a mullion, wherein the cooling module set is at least partially enclosed in the mullion.

21. The method of producing an appliance that is reconfigurable by an end user after initial manufacturing at a factory comprising the steps of:

providing an insulated appliance cabinet having a plurality of interior surfaces;

installing an orientation-flexible compressor within a cooling module set wherein the orientation flexible compressor functions in at least both a vertical orientation and a horizontal orientation;

removably engaging the cooling module set containing mullion in a first position by removably engaging the cooling module set to at least one of the plurality of interior surfaces to thereby form at least one of a freezer compartment and a refrigerator compartment and wherein the cooling module set operates in any orientation of a plurality of orientations; and repositioning the cooling module set containing mullion to a position where the cooling module set is engaged to at least one of the plurality of interior surfaces at a different position than the first position to alter the shape of the at least one of a freezer compartment and a refrigerator compartment.

22. The method of claim 21, wherein the step of removably engaging the cooling module set containing mullion in a first position forms both a refrigerator compartment having an opening and a freezer compartment having an opening and wherein the orientation flexible compressor is an oil-less compressor.

23. The method of claim 22, wherein the cooling module set is configured to operate in a plurality of positions without affecting the operation of the cooling module set and wherein the plurality of positions include and are chosen from the group consisting of: an approximately a vertical position with respect to a normal operating orientation of the refrigerator and an approximately horizontal position with respect to the normal operating orientation of the refrigerator.

24. The method of claim 23 further comprising the step of engaging at least one reconfigurable door to be operably connected to the appliance cabinet and moveable between an open position and a closed position with respect to the opening of the freezer compartment or the opening of the refrigerator compartment.

25. The method of claim 24, wherein the at least one reconfigurable door includes a first reconfigurable door and a second reconfigurable door and wherein the method further comprises the step of engaging a first reconfigurable door which corresponds to the freezer compartment, wherein a size of the first reconfigurable door approximately corresponds with the opening of the freezer compartment that occurs when the first reconfigurable door is in an open position, and the second reconfigurable door corresponds to the refrigerator compartment, wherein a size of the second reconfigurable door at least approximately corresponds with an opening of the refrigerator compartment that occurs when the second reconfigurable door is in an open position.

* * * * *